US010689231B2

(12) United States Patent
Schedl

(10) Patent No.: US 10,689,231 B2
(45) Date of Patent: Jun. 23, 2020

(54) BELT SAFETY DEVICE AND PEOPLE CONVEYOR WITH A BELT SAFETY DEVICE

(71) Applicant: Otis Elevator Company, Farmington, CT (US)

(72) Inventor: Philipp Schedl, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/413,023

(22) Filed: May 15, 2019

(65) Prior Publication Data

US 2019/0352141 A1 Nov. 21, 2019

(30) Foreign Application Priority Data

May 16, 2018 (EP) ..... 18172719

(51) Int. Cl.

| | |
|---|---|
| ***B66B 21/04*** | (2006.01) |
| ***B66B 23/02*** | (2006.01) |
| ***B66B 29/00*** | (2006.01) |
| ***B66B 25/00*** | (2006.01) |
| ***B66B 21/10*** | (2006.01) |
| ***B66B 27/00*** | (2006.01) |

(52) U.S. Cl.

CPC ..... *B66B 25/006* (2013.01); *B66B 21/04* (2013.01); *B66B 21/10* (2013.01); *B66B 23/02* (2013.01); *B66B 27/00* (2013.01); *B66B 29/00* (2013.01)

(58) Field of Classification Search

CPC ..... B66B 23/02; B66B 29/00
USPC ..... 198/322, 323
See application file for complete search history.

(56) References Cited

U.S. PATENT DOCUMENTS

| | | | | |
|---|---|---|---|---|
| 5,099,977 | A * | 3/1992 | Hirose | B66B 23/02 198/323 |
| 6,457,573 | B1 * | 10/2002 | Ostermeier | B66B 23/02 198/330 |
| 6,569,046 | B1 | 5/2003 | Gregg | |
| 6,997,302 | B2 | 2/2006 | Fargo et al. | |
| 7,303,125 | B2 | 12/2007 | Lin et al. | |
| 7,497,315 | B2 * | 3/2009 | Fargo | B66B 23/02 198/322 |
| 8,079,455 | B2 | 12/2011 | Boge et al. | |

(Continued)

FOREIGN PATENT DOCUMENTS

| | | | |
|---|---|---|---|
| DE | 1198593 | B | 8/1965 |
| DE | 19522622 | A1 | 1/1997 |

(Continued)

OTHER PUBLICATIONS

European Search Report for application 18172719.9, dated Nov. 19, 2018, 9 pages.

*Primary Examiner* — James R Bidwell
(74) *Attorney, Agent, or Firm* — Cantor Colburn LLP

(57) ABSTRACT

A belt safety device (2) for monitoring a drive belt (15), in particular a drive belt (15) of a people conveyor (1), comprises a sensor wheel (34) configured to be driven by the monitored drive belt (15); a sensor surface (42); an indicator element (40) extending eccentrically from the sensor wheel (34) and moving along the sensor surface (42) when the sensor wheel (34) rotates; and an evaluation unit (44), which is configured for determining the path (P) of the indicator element (40) moving along the sensor surface (42).

13 Claims, 6 Drawing Sheets

(56) References Cited

U.S. PATENT DOCUMENTS

| | | | | |
|---|---|---|---|---|
| 8,839,942 | B2 | 9/2014 | Tautz et al. | |
| 10,118,802 | B2 * | 11/2018 | Borthakur | B66B 23/02 |
| 2002/0104715 | A1 | 8/2002 | Zaharia et al. | |
| 2017/0297874 | A1 | 10/2017 | Borthakur et al. | |
| 2018/0244502 | A1 * | 8/2018 | Henkel | B66B 25/00 |

FOREIGN PATENT DOCUMENTS

| | | | |
|---|---|---|---|
| DE | 202007010280 | U1 | 9/2007 |
| GB | 2263200 | A | 7/1993 |
| JP | H06337972 | A | 12/1994 |
| JP | 2941373 | B2 | 8/1999 |
| JP | 3342598 | B2 | 11/2002 |
| JP | 4583585 | B2 | 11/2010 |
| JP | 5199028 | B2 | 5/2013 |
| JP | 5340843 | B2 | 11/2013 |
| WO | 03099698 | A1 | 12/2003 |
| WO | 2007080890 | A1 | 7/2007 |
| WO | 2010092619 | A1 | 8/2010 |
| WO | 2015002470 | A1 | 1/2015 |
| WO | 2017042006 | A1 | 3/2017 |
| WO | 2017149694 | A1 | 9/2017 |

* cited by examiner

BELT SAFETY DEVICE AND PEOPLE CONVEYOR WITH A BELT SAFETY DEVICE

FOREIGN PRIORITY

This application claims priority to European Patent Application No. 18172719.9, filed May 16, 2018, and all the benefits accruing therefrom under 35 U.S.C. § 119, the contents of which in its entirety are herein incorporated by reference.

BACKGROUND

The invention relates to a belt safety device for monitoring a belt, in particular a drive belt of a people conveyor. The invention further relates to a people conveyor comprising a drive belt and at least one belt safety device.

People conveyors such as escalators and moving walkways comprise a plurality of conveyance elements, such as steps or pallets, moving in a conveyance direction. In some embodiments, the conveyance elements are connected with and driven by an endless drive belt.

It would be beneficial to be able to detect any damage of the drive belt at an early stage, in order to avoid additional damage or severe safety issues which may result from operating the people conveyor with a damaged drive belt.

SUMMARY

According to an exemplary embodiment of the invention, a belt safety device for monitoring a drive belt, in particular a drive belt employed in a people conveyor, comprises a sensor wheel which is configured to be driven by the drive belt to be monitored. The belt safety device further comprises a sensor surface and an indicator element extending eccentrically from the sensor wheel so that the indicator element moves along a predetermined path at the sensor surface when the sensor wheel rotates. The belt safety device also comprises an evaluation unit which is configured for determining the path of the indicator element moving along the sensor surface for detecting damage of the drive belt.

Exemplary embodiments of the invention further include a people conveyor comprising a chain of conveyance elements, at least one drive belt connected to the chain of conveyance elements, and at least one belt safety device configured for monitoring said at least one drive belt. The sensor wheel of the at least one belt safety device is driven by the at least one drive belt.

A belt safety device according to exemplary embodiments of the invention is easy to implement at low costs. It allows reliably detecting damage of the drive belt at an early stage. In consequence, appropriate measures, such as stopping any further operation of the people conveyor may be taken, in order to avoid additional damage or severe safety issues which may result from operating the people conveyor with a damaged drive belt.

A number of optional features are set out in the following. These features may be realized in particular embodiments, alone or in combination with any of the other features.

The drive belt may be a toothed drive belt, and the sensor wheel may be a toothed sensor wheel configured for engaging with the toothed drive belt. With such a configuration, missing or damaged teeth of a toothed drive belt may be detected easily and with high reliability.

The evaluation unit may be configured for determining the path of the indicator element in at least one dimension, in particular in exactly one dimension. Although the path of the indicator element in the sensor surface generally describes a two-dimensional pattern, for the purpose of the present invention, it is sufficient to determine the path of the indicator element in only one dimension. Determining the path of the indicator element in only one dimension allows reducing the costs for the belt safety device, in particular the costs for the sensor surface and the evaluation unit.

The indicator element may comprise or be an electrical conductor contacting the sensor surface; and the sensor surface may have an electric resistance varying in at least one dimension. Such a configuration allows determining the position of the indicator element on the sensor surface by measuring an electrical current flowing through the indicator element to the sensor surface.

For determining the path of the indicator element moving along the sensor surface, the evaluation unit may be configured for applying an electrical voltage to the indicator element and an electric contact attached to a contact side of the sensor surface, and for measuring an electrical current flowing through the indicator element as a function of time. In such a configuration, the indicator element and the sensor surface constitute an electrical potentiometer the electrical resistance of which varies as a function of the position of the indicator element on the sensor surface, in particular as a function of the distance between the indicator element and the electric contact attached to the contact side of the sensor surface. Such a configuration therefore provides a reliable way of determining the path of the indicator element moving along the sensor surface which is easy to implement at lows costs.

The electric resistance of the potentiometer formed by the indicator element and the sensor surface may vary linearly, exponentially or logarithmically along the at least one dimension. A homogeneous sensor surface effects that the electrical resistance between two points on the sensor surface varies linearly with the distance between said two points. This results in a sinusoidal signal when the indication element moves along a circular path with constant rotational velocity. A sinusoidal signal may be advantageous for evaluating the signal in order to detect damaged of the drive belt. Further, a homogeneous sensor surface is easy to produce at low costs.

Depending on the kind of detection, alternatively sensor surfaces having exponentially or logarithmically varying electric resistances may be employed. The skilled person will understand that sensor surfaces having electric resistances varying according to other regular or irregular patterns may be employed as well.

For detecting damage of the drive belt, the evaluation unit is configured for comparing the determined path of the indicator element with at least one reference pattern. The at least one reference pattern may represent an intact drive belt. In this case, (considerable) deviation of the actual pattern from the reference pattern may be considered as indicating a damaged drive belt.

Alternatively, the at least one reference pattern may represent a damaged drive belt. In this case, (sufficient) agreement of the actual pattern with the reference pattern is considered as indicating a damaged drive belt.

The at least one predetermined pattern may be recorded in a learning run. In such a learning run, the people conveyor may be operated with a drive belt which is known to be intact, and the pattern provided by the sensor during said run is recorded and stored as a reference pattern representing an intact drive belt.

Alternatively or additionally, a damaged drive belt may detected by means of pattern recognition identifying specific features within the pattern indicating damage of the drive belt.

A people conveyor according to an exemplary embodiment of the invention may comprise a support structure, in particular a truss, and the sensor wheel may be mounted to said support structure. The sensor surface may be formed on or mounted to the support structure of the people conveyor as well.

A people conveyor according to an exemplary embodiment of the invention may comprise at least two drive belts and at least two belt safety devices. At least one belt safety device may be configured for monitoring each of the drive belts, respectively. Such a configuration allows for a secure operation of people conveyors comprising more than one drive belt.

The people conveyor may be an escalator in which the conveyance elements are steps. Alternatively, the people conveyor may be a moving walkway in which the conveyance elements are pallets. In a moving walkway, the chain of conveyance elements (pallets) may be inclined with respect to the horizontal, or it may extend horizontally.

DRAWING DESCRIPTION

In the following exemplary embodiments of the invention are described with reference to the enclosed figures.

Figure 6:
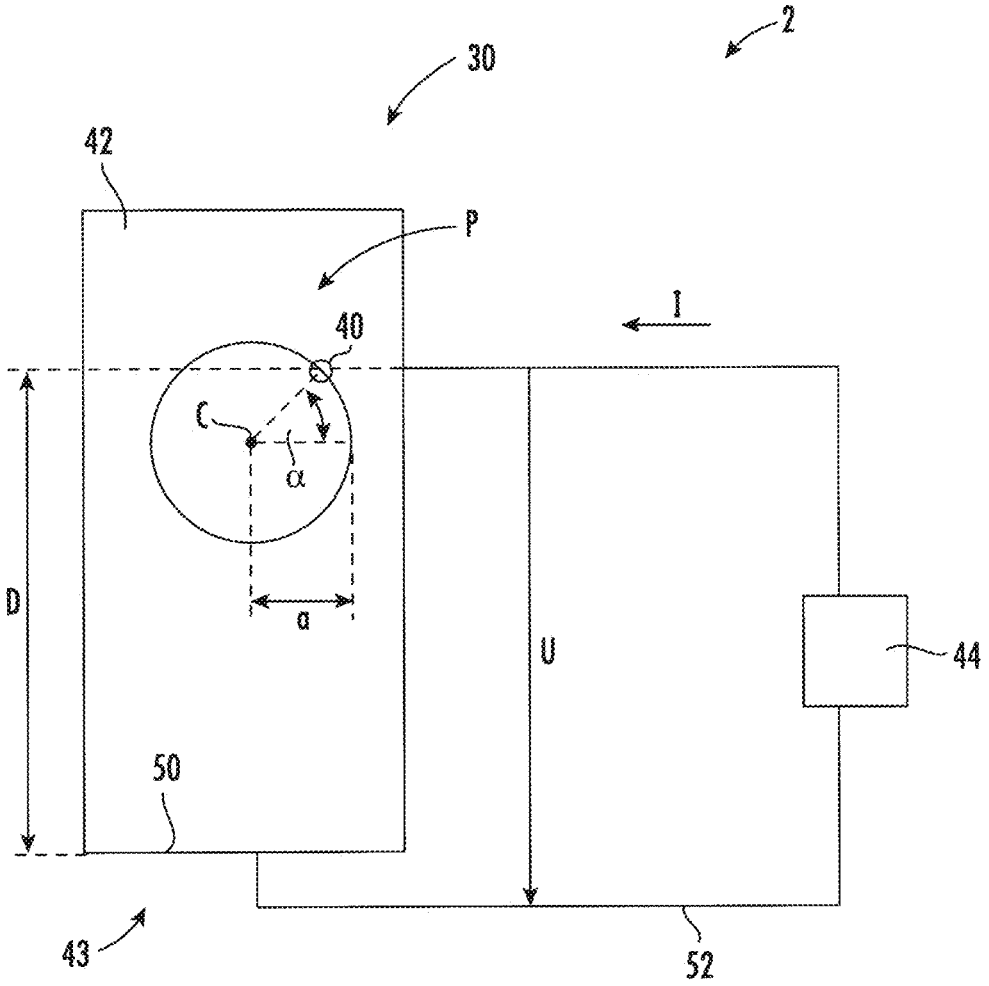

FIG. 6 schematically illustrates the functionality of said sensor.

DETAILED DESCRIPTION

Figure 1:
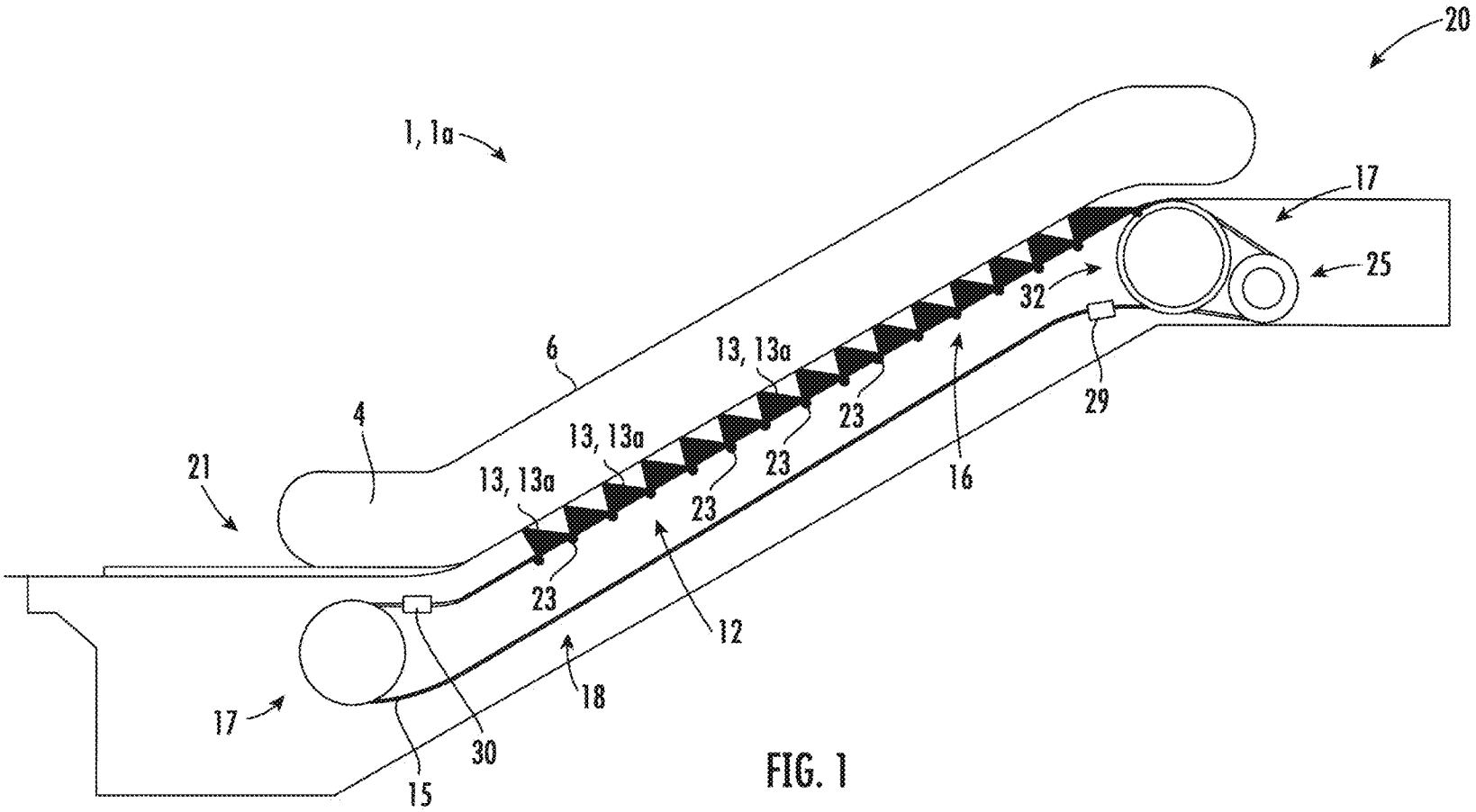
FIG. 1 depicts a schematic side view of an escalator.

FIG. 1 shows a schematic side view of a people conveyor 1, in particular an escalator 1*a*, comprising a chain 12 of conveyance elements 13 (steps 13*a*) extending in a longitudinal conveyance direction between two landing portions 20, 21. The conveyance elements 13 comprise rollers 23 which are guided and supported by guide rails (not shown).

In turnaround portions 17 next to the landing portions 20, 21, the chain 12 of conveyance elements 13 passes from a conveyance portion 16 into a return portion 18, and vice versa.

For clarity, only some of the conveyance elements 13, in particular conveyance elements 13 in the conveyance portion 16, are depicted in FIG. 1. Further, not all conveyance elements 13 and rollers 23 are denoted with reference signs.

A drive belt 15 extending along a closed loop is connected to the chain 12 of conveyance elements 13. The drive belt 15 is a toothed belt with teeth formed at least on the inner side of the loop. The drive belt 15 is in engagement with and driven by at least one toothed sheave 32 arranged in one of the turnaround portions 17. A people conveyor drive 25 is configured for driving the toothed sheave 32.

The people conveyor 1 further comprises a brake 29 which is configured for braking movement of the chain 12 of conveyance elements 13. The brake 29 may engage with the toothed sheave 32 or a shaft of the toothed sheave 32. The brake 29 is depicted separately from the people conveyor drive 25 in FIG. 1. The brake 29, however, may be integrated with the people conveyor drive 25.

Balustrades 4 supporting moving handrails 6 extend parallel to the conveyance portion 16. Only one of the balustrades 4 is visible in the side view shown in FIG. 1.

For detecting damage of the drive belt 15, a sensor 30 is arranged next to the drive belt 15. The functionality of said sensor 30 is described further below with reference to FIGS. 3 to 5.

Figure 2:
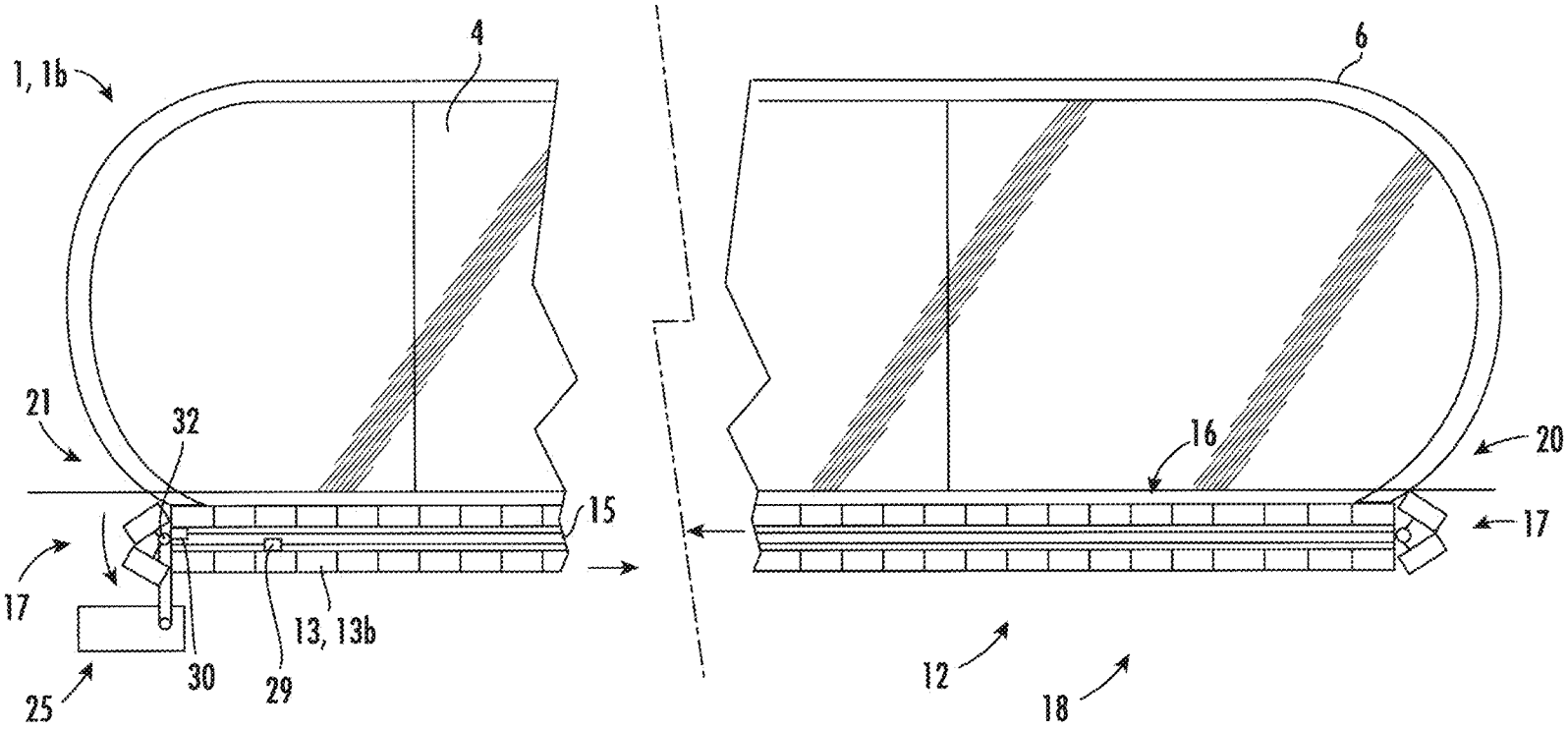
FIG. 2 depicts a schematic side view of a moving walkway.

FIG. 2 depicts a schematic side view of a people conveyor 1, which is provided as a moving walkway 1*b*.

The moving walkway 1*b* comprises an endless chain 12 of conveyance elements 13 (pallets 13*b*) moving in a longitudinal conveyance direction in an upper conveyance portion 16 and opposite to the conveyance direction in a lower return portion 18.

Landing portions 20, 21 are provided at both ends of the moving walkway 1. In turnaround portions 17 next to the landing portions 20, 21 the chain 12 of conveyance elements 13 passes from the conveyance portion 16 into the return portion 18, and vice versa. Again, for clarity not all conveyance elements 13 (pallets 13*b*) are provided with reference signs.

Balustrades 4 supporting moving handrails 6 extend parallel to the conveyance portion 16 on both lateral sided of the chain 12 of conveyance elements 13. Only one of the balustrades 4 is visible in the side view depicted in FIG. 2.

Similar to the embodiment shown in FIG. 1, the chain 12 of conveyance elements 13 is connected with a toothed endless drive belt 15. In at least one of the turnaround portions 17 the endless drive belt 15 is in engagement with a toothed sheave 32. When the moving walkway 1*b* is operated, the toothed sheave 32 is driven by a people conveyor drive 25 for driving the chain 12 of conveyance elements 13.

The people conveyor 1 further comprises a brake 29 which is configured for braking movement of the chain 12 of conveyance elements 13. Although depicted separately, the brake 29 may be integrated with the people conveyor drive 25.

A sensor 30 configured for detecting damage of the drive belt 15 is arranged next to the drive belt 15.

Figure 3:
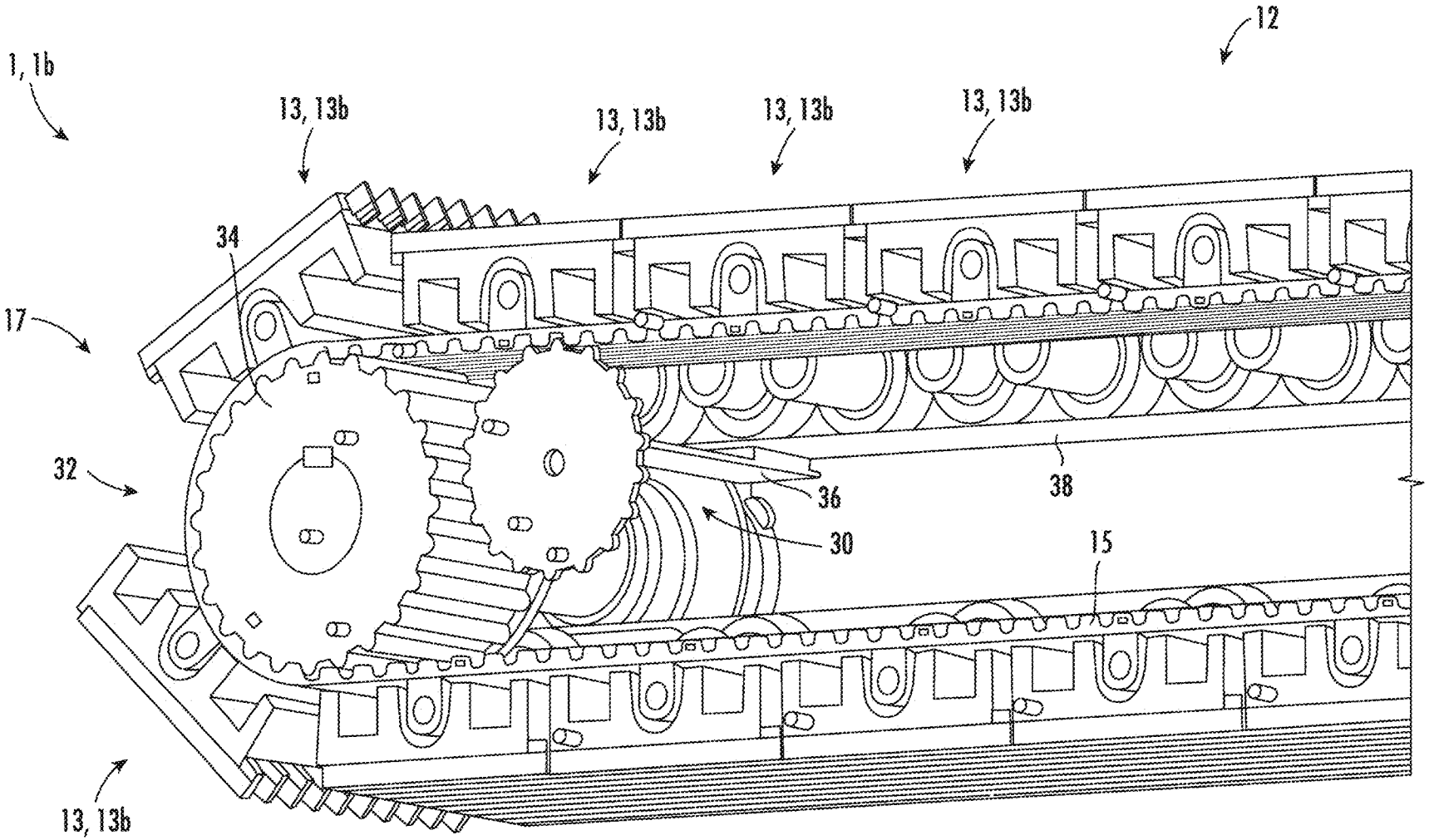
FIG. 3 shows an enlarged perspective view of a portion of a moving walkway in the vicinity of one of its landing portions.

FIG. 3 shows an enlarged perspective view of a portion of a chain 12 of conveyance elements 13 of a people conveyor 1, in particular a moving walkway 1*b*, close to one of the turnaround portions 17.

Although the people conveyor 1 depicted in FIG. 3 is a moving walkway 1*b* comprising a plurality of pallets 13*b*, the skilled person understands that the invention similarly applies to an escalator 1*a* comprising a plurality of steps 13*a* instead of pallets 13*b*.

As depicted in FIG. 3, a sensor 30 configured for detecting damage of the drive belt 15 is arranged close to the toothed sheave 32 engaging with the drive belt 15.

The positions of the sensor 30 illustrated in FIGS. 1, 2 and 3, however, are only exemplary. The sensor 30 may be arranged at any desired position along the extension of the drive belt 15. A sensor 30 according to an exemplary embodiment of the invention in particular may be arranged in the conveyance portion 16 and/or in the return portion 18 of the people conveyor 1.

The sensor 30 comprises a support 36 and a toothed sensor wheel 34 engaging with the teeth of the drive belt 15. The support 36 is attached to a portion of a support structure (truss) 38 of the people conveyor 1.

The sensor wheel 34 may be rotatably supported by the support 36 or by another support structure not depicted in the figures.

Figure 4:
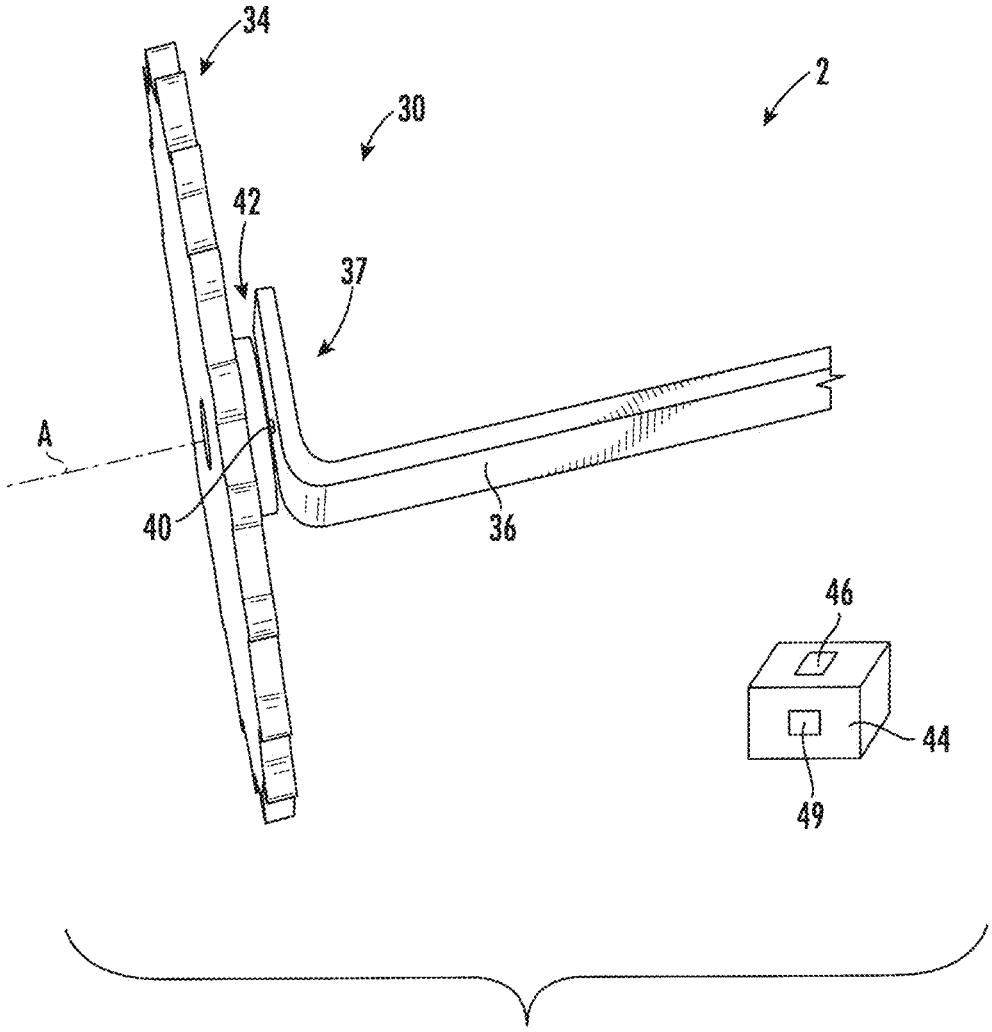
FIG. 4 depicts an enlarged perspective view of a belt safety device according to an exemplary embodiment of the invention.

FIG. 4 depicts an enlarged perspective view of a belt safety device 2 comprising the sensor 30 and an evaluation unit 44.

Figure 5:
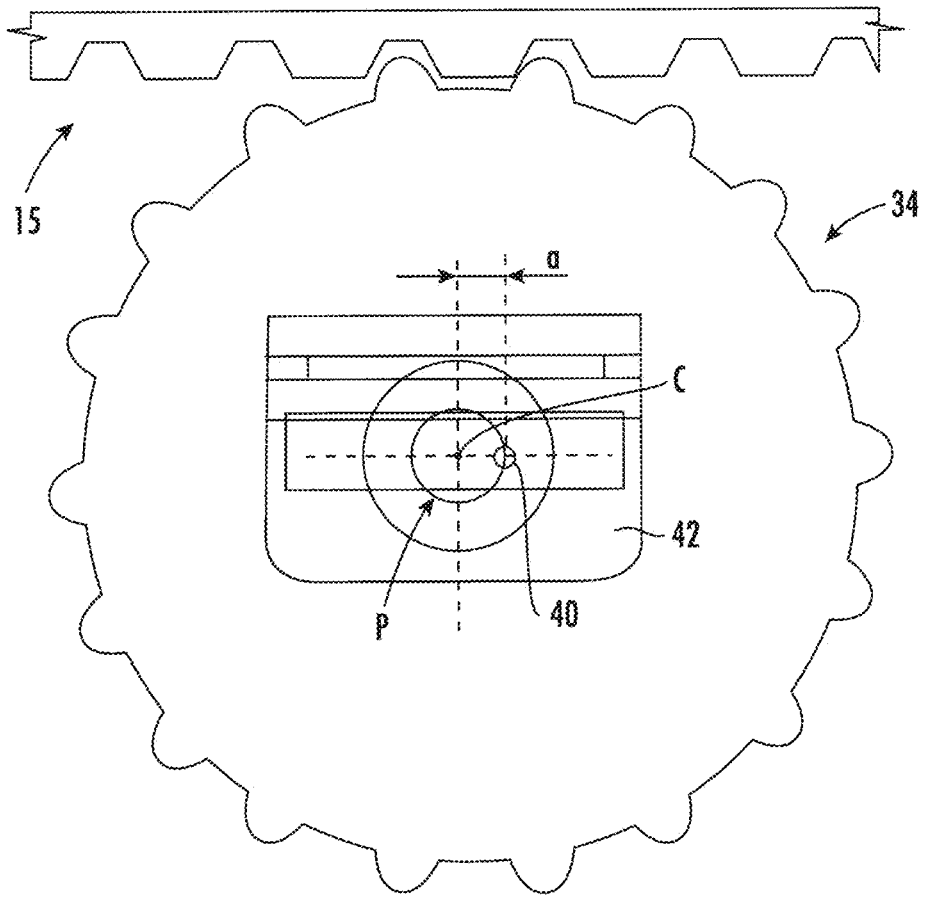
FIG. 5 shows a sectional view through a sensor of a belt safety device according to an exemplary embodiment of the invention.

FIG. 5 shows a sectional view through the sensor 30 in engagement with the drive belt 15.

FIG. 6 schematically illustrates the functionality of the sensor 30.

At the side facing the sensor wheel 34, the support 36 comprises a cranked end portion 37. The end portion 37 is cranked with respect to a main portion of the support 36 so that it extends parallel to the plane of the sensor wheel 34. A sensor surface 42 is formed on the face of the end portion 37 facing the sensor wheel 34.

The sensor surface 42 in particular is an electrically conducting surface.

An indicator element 40 extends from the sensor wheel 34 towards the sensor surface 42. The indicator element 40 in particular is an electrical conductor, or at least comprises an electrical conductor. The indicator element 40 contacts the sensor surface 42 allowing an electrical current I to flow between the indicator element 40 and the sensor surface 42.

The indicator element 40 may be a (metallic) pin or protrusion attached to or formed integrally with the sensor wheel 34. The indicator element 40 is positioned eccentrically, i.e. at a distance a>0 from the center C of the sensor wheel 34 (cf. FIGS. 5 and 6). In consequence, when the sensor wheel 34 rotates, the indicator element 40 moves along a circular path P on the sensor surface 42.

In case the sensor surface 42 is homogeneous, the electrical resistance R between an electric contact 50 provided at a contact side 43 of the sensor surface 42 and the indicator element 40 (see FIG. 6) varies linearly with the distance d between the electric contact 50 and the indicator element 40.

An evaluation unit 44 is electrically connected by means of electric contactors 52 with the indicator element 40 and the electric contact 50 provided at the contact side 43 of the sensor surface 42. The evaluation unit 44 in particular is configured for applying an electrical voltage U between the indicator element 40 and the electric contact 50 (cf. FIG. 6).

Since the electrical resistance R between the indicator element 40 and the electric contact 50 varies with the distance d between the indicator element 40 and the electric contact 50, the combination of the indicator element 40 and the sensor surface 42 constitutes a "surface potentiometer". Thus, when a constant voltage U is applied between the indicator element 40 and the electric contact 50, the electrical current I flowing through the indicator element 40 and the sensor surface 42 varies with the position of the indicator element 40 on the sensor surface 42.

As mentioned, the indicator element 40 moves along a circular path P over the sensor surface 42 when the sensor wheel 34 rotates. Thus, when a constant voltage U is applied between the indicator element 40 and the electric contact 50, the electrical current I flowing through the indicator element 40 varies periodically in a predetermined pattern. Said pattern is defined by the distance a between the indicator element 40 and the center C of the sensor wheel 34, by the spatial variation of the resistance of the sensor surface 42, and by the rotational velocity ω of the sensor wheel 34.

For example, in case the sensor surface 42 is homogeneous, the resistance R between the electric contact 50 and the indicator element 40 varies linearly with the distance d between the electric contact 50 and the indicator element 40, and thus in an ideal situation neglecting noise, the electrical current I flowing through the indicator element 40 follows a sinusoidal curve:

$$I(t)=U/R(d(t))$$

$$I(t)=I_0+A*\sin(\alpha(t))$$

$$I(t)=I_0+A*\sin(\omega t+\varphi).$$

The frequency of said variation is set by the rotational velocity ω of the sensor wheel 34. The amplitude A is determined by the resistance R of the sensor surface 42, the applied voltage U, and by the distance a between the indicator element 40 and the center C of the sensor wheel 34. φ is a phase factor representing the rotational position of the sensor wheel at t=0.

In case the drive belt 15 is damaged or broken, the pattern of the electrical current I flowing through the indicator element 40 is significantly different.

When the drive belt 15 is completely broken, the sensor wheel 34 is not driven by the drive belt 15 anymore. In consequence, the position of the indicator element 40 on the sensor surface 42 does not change resulting in a constant electrical current I flowing through the indicator element 40.

In case the drive belt 15 is not completely broken, but at least one of the teeth of the drive belt 15 is missing or damaged, the sensor wheel 34 might still rotate. The sensor wheel 34, however, will not rotate with a constant rotational velocity ω, but the rotational velocity will vary when a damaged portion of the drive belt 15 passed the sensor wheel 34. For example, when one or more teeth of the drive belt 15 are missing, the sensor wheel 34 will rotate slower or even stop rotating for a short period of time when a damaged (toothless) portion of the drive belt 15 passes the sensor wheel 34.

In consequence, the evaluation unit 44 is able to detect damage of the drive belt 15 by analyzing the pattern of the electrical current I flowing through the indicator element 40.

The evaluation unit 44 for example may comprise a (micro-)processor 46 controlled by a program, which is configured for analyzing the pattern of the electrical current I flowing through the indicator element 40.

Said analysis may be based on pattern recognition. Pattern recognition may, e.g., include determining whether the pattern of electrical current I flowing through the indicator element 40 has a sinusoidal shape and/or whether the frequency of the electrical current I is within a predetermined range corresponding to the normal speed of operation of the people conveyor 1.

Alternatively or additionally, the analysis may include comparing the pattern of the electrical current I flowing through the indicator element 40 with at least one predetermined pattern stored in a memory 48 of the evaluation unit 44.

The at least one predetermined pattern may, e.g., correspond to an intact drive belt 15. In this case, damage of the drive belt 15 is detected when a calculated difference between the actual pattern of the electrical current I and a given pattern of the electrical current I exceeds a given threshold.

Alternatively or additionally, the at least one predetermined pattern may represent a damaged drive belt 15. In this case, the drive belt 15 is determined as being damaged when a calculated difference between the actual pattern of the electrical current I and the predetermined pattern of the electrical current I does not exceed a given threshold.

The evaluation unit 44 may be configured for issuing an alarm signal when the evaluation of the received signals indicates that the drive belt 15 is damaged or broken.

The evaluation unit 44 in particular may be configured for issuing an alarm signal only after damage of the drive belt 15 has been detected repeatedly for a predetermined number of times in order to avoid false alarms. The evaluation unit 44 in particular may be configured for issuing an alarm signal only after damage of the drive belt 15 has been detected repeatedly for a predetermined number of times within a predetermined time frame.

The alarm signal may result in informing a technician about the detected damage so that the technician may visit the people conveyor 1 in order to check and repair the damaged drive belt 15. Alternatively or additionally, the alarm signal may cause stopping any further operation of the people conveyor 1 in order to prevent additional damage or even severe safety issues which may result from operating the people conveyor 1 with a damaged drive belt 15.

Stopping the operation of the people conveyor 1 may further include engaging the brake 29 of the people conveyor 1 in order to prevent any further movement of the chain 12 of conveyance elements 13.

Engaging the brake 29 in particular is beneficial when the people conveyor 1 is an escalator 1*a* or an inclined moving walkway 1*b* in which the chain 12 of conveyance elements 13 may be driven by gravity even after the active operation (driving) of the people conveyor drive 25 has been stopped.

Although only one drive belt 15 is depicted in each of the figures, the skilled person will understand that the people conveyor 1 may comprise two drive belts 15, in particular two drive belts 15 extending parallel to each other. At least one sensor 30 may be arranged laterally next to each of the drive belts 15 for monitoring the respective drive belt 15.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

REFERENCES

1 people conveyor
2 belt safety device
1*a* escalator
1*b* moving walkway
4 balustrade
6 moving handrail
12 chain of conveyance elements
13 conveyance elements
13*a* steps
13*b* pallets
15 drive belt
16 conveyance portion
17 turnaround portion
18 return portion
20, 21 landing portions
23 rollers
25 people conveyor drive
27 transmission element
29 brake
30 sensor
32 toothed sheave
34 sensor wheel
36 support
37 end portion of the support
38 support structure
40 indicator element
42 sensor surface
43 contact side of the sensor surface
44 evaluation unit
46 (micro-)processor
48 memory
50 electric contact
52 electric contactors
A amplitude
a distance between the indicator element and the center of the sensor wheel
C center of the sensor wheel
d distance between the indicator element and the electric contact
I electrical current
P path of the indicator element
R electrical resistance
t time
U electrical voltage
$\alpha$ angular position of the indicator element
$\varphi$ phase factor
$\omega$ rotational velocity

What is claimed is:

1. Belt safety device for monitoring a drive belt, the belt safety device comprising:
a sensor wheel configured to be driven by the drive belt;
a sensor surface;
an indicator element extending eccentrically from the sensor wheel and moving along a path (P) at the sensor surface when the sensor wheel rotates; and
an evaluation unit, which is configured for determining the path (P) of the indicator element moving along the sensor surface for detecting damage of the drive belt;
wherein the indicator element comprises an electrical conductor contacting the sensor surface;
wherein the sensor surface has an electric resistance varying in at least one dimension.

2. Belt safety device according to claim 1, wherein the evaluation unit is configured for determining the path (P) of the indicator element in at least one dimension.

3. Belt safety device according to claim 1, wherein the electric properties of the sensor surface are homogeneous.

4. Belt safety device for monitoring a drive belt, the belt safety device comprising:
a sensor wheel configured to be driven by the drive belt;
a sensor surface;
an indicator element extending eccentrically from the sensor wheel and moving along a path (P) at the sensor surface when the sensor wheel rotates; and
an evaluation unit, which is configured for determining the path (P) of the indicator element moving along the sensor surface for detecting damage of the drive belt;
wherein the indicator element comprises an electrical conductor contacting the sensor surface;
wherein the evaluation unit is configured for applying an electrical voltage (U) to the indicator element and to an electric contact attached to a contact side of the sensor surface, and for measuring an electrical current (I)

flowing through the indicator element for determining the path (P) of the indicator element moving along the sensor surface.

5. Belt safety device according to claim 1, wherein the evaluation unit is configured for comparing the determined path (P) of the indicator element with at least one reference pattern.

6. Belt safety device according to claim 5, wherein the at least one reference pattern represents a damaged drive belt and/or an intact drive belt.

7. Belt safety device according to claim 1, wherein the sensor wheel is a toothed sensor wheel configured for engaging with a toothed drive belt.

8. People conveyor comprising a chain of conveyance elements connected and driven by at least one drive belt; and at least one belt safety device according to claim 1, wherein the sensor wheel of the at least one belt safety device (2) is configured for being driven by the at least one drive belt.

9. People conveyor according to claim 8, wherein the at least one drive belt is a toothed drive belt, and wherein the at least one sensor wheel is a toothed sensor wheel engaging with the toothed drive belt.

10. People conveyor according to claim 8, comprising at least two drive belts and at least two belt safety devices, wherein at least one belt safety device is configured for monitoring each of the drive belts, respectively.

11. People conveyor according to claim 8, comprising a support structure, wherein the sensor wheel of at least one belt safety device is attached to the support structure and/or wherein the sensor surface is formed on or attached to the support structure.

12. People conveyor according to claim 8, wherein the people conveyor is an escalator comprising a plurality of steps as conveyance elements.

13. People conveyor according to claim 8, wherein the people conveyor is a moving walkway comprising a plurality of pallets as conveyance elements.

* * * * *